US006217286B1

(12) United States Patent
Huang et al.

(10) Patent No.: US 6,217,286 B1
(45) Date of Patent: Apr. 17, 2001

(54) UNIDIRECTIONALLY SOLIDIFIED CAST ARTICLE AND METHOD OF MAKING

(75) Inventors: Shyh-Chin Huang, Latham, NY (US); Phillip Harold Monaghan, Hampton, VA (US); Ji-Cheng Zhao, Niskayuna; Michael Francis Xavier Gigliotti, Jr., Scotia, both of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/105,239

(22) Filed: Jun. 26, 1998

(51) Int. Cl.[7] ..... B63H 1/26; C22C 27/06
(52) U.S. Cl. ..... 416/241 R; 148/404
(58) Field of Search ..... 416/241 R; 148/404

(56) References Cited

U.S. PATENT DOCUMENTS

| | | | | |
|---|---|---|---|---|
| 3,008,855 | * | 11/1961 | Swenson | 416/241 R |
| 3,031,403 | * | 4/1962 | Bennett, Jr. | 148/404 |
| 3,129,061 | * | 4/1964 | Dermatis et al. | 148/404 X |
| 3,260,505 | * | 7/1966 | Snyder | 148/404 X |
| 3,342,455 | * | 9/1967 | Fleck et al. | 416/241 R |
| 3,494,709 | * | 2/1970 | Piearcey | 148/404 X |
| 3,564,940 | * | 2/1971 | Thompson et al. | 148/404 |
| 3,567,526 | * | 3/1971 | Gell et al. | 148/404 |
| 3,580,324 | * | 5/1971 | Copley et al. | 164/122.2 |
| 3,677,835 | | 7/1972 | Tien et al. | 148/404 |
| 3,714,977 | | 2/1973 | Terkelsen | 164/122.1 |
| 3,915,761 | | 10/1975 | Tschinkel et al. | 148/32 |
| 4,108,236 | | 8/1978 | Salkeld | 164/122.1 X |
| 4,205,983 | * | 6/1980 | Flemings et al. | 420/590 |
| 4,548,255 | * | 10/1985 | Reiner et al. | 164/122.2 X |
| 4,681,787 | | 7/1987 | Hunt | 428/577 |
| 4,707,192 | * | 11/1987 | Yamazaki et al. | 148/404 X |
| 4,838,340 | * | 6/1989 | Entrekin et al. | 164/455 |
| 4,842,953 | * | 6/1989 | Perkins et al. | 416/241 R X |
| 5,069,873 | * | 12/1991 | Harris et al. | 148/404 X |
| 5,366,695 | * | 11/1994 | Erickson | 148/404 X |
| 5,489,194 | | 2/1996 | Yoshinari et al. | 416/241 R |
| 5,489,346 | * | 2/1996 | Erickson | 148/404 |
| 5,584,663 | * | 12/1996 | Schell et al. | 416/241 R |
| 5,611,670 | | 3/1997 | Yoshinari et al. | 416/241 R |
| 5,620,308 | | 4/1997 | Yoshinari et al. | 416/241 R |
| 5,712,050 | * | 1/1998 | Goldman et al. | 416/241 R X |
| 5,843,586 | * | 12/1998 | Schaeffer et al. | 148/404 X |
| 5,858,558 | * | 1/1999 | Zhao et al. | 148/404 X |
| 5,900,170 | * | 5/1999 | Marcin et al. | 148/525 X |
| 5,906,096 | * | 5/1999 | Siga et al. | 416/216.1 X |
| 5,914,059 | * | 6/1999 | Marcin et al. | 148/525 X |
| 5,975,852 | * | 11/1999 | Nagaraj et al. | 416/241 R |

FOREIGN PATENT DOCUMENTS

| | | |
|---|---|---|
| 1303027 | 1/1973 | (GB) . |
| 1547817 | 6/1979 | (GB) . |

OTHER PUBLICATIONS

"The Breakdown of Single–Crystal Solidification in High Refractory Nickel–Base Alloys", by T.M. Pollock et al., Metallurgical and Materials Transactions A, vol. 27A, Apr. 1996, pp. 1081–1094.
Patent Abstract of Japan (10131705).

* cited by examiner

*Primary Examiner*—John E. Ryznic
(74) *Attorney, Agent, or Firm*—Noreen C. Johnson; Douglas E. Stoner

(57) ABSTRACT

A cast superalloy article having a unidirectional crystal structure that is substantially defect free with primary dendrite arm spacing greater than 150 $\mu$m is provided. The unidirectional crystalline microstructure comprises a longitudinal columnar structure aligned parallel with the direction of solidification where said columnar structure is a single crystal or polycrystals or mixtures thereof.

35 Claims, 4 Drawing Sheets

UNIDIRECTIONALLY SOLIDIFIED CAST ARTICLE AND METHOD OF MAKING

BACKGROUND OF THE INVENTION

This invention relates to a unidirectional solidified cast article having a columnar crystalline microstructure. In particular the invention relates to a cast superalloy article having at least one columnar crystal that is substantially free of defects. The invention further relates to a casting method to produce the cast article. Still yet, the invention relates to gas turbines having unidirectional solidified cast articles, such as blades, buckets, nozzles, vanes, and airfoils.

The mechanical properties of cast superalloy articles improve by applying directional casting techniques to produce columnar polycrystalline or single crystal articles. Single crystal articles differ from polycrystalline articles primarily by the absence of boundaries between differently or arbitrarily oriented crystals. Both single crystal and polycrystalline articles can have a columnar structure.

Directional casting techniques used to manufacture single crystal and polycrystalline articles start with a mold shaped to produce the desired cast article. One such process of manufacturing columnar single crystal and polycrystalline cast articles employs a Bridgman-type furnace and comprises the pouring of molten metal into a mold within a heated zone. A chill plate cools the base of the mold (water-cooled). Subsequent crystallization of the molten metal occurs by gradually withdrawing the mold from the heated zone. Convection and/or radiation cools the mold from the bottom and then upward to solidify the cast metal. Another process for making directionally solidified cast articles comprises pouring molten metal into a superheated mold situated in a heated zone and withdrawing the mold from the furnace into a liquid coolant bath. The coolant bath has a temperature lower than the solidus temperature of the cast superalloy metal.

While casting vendors use variations of both casting processes today, the quality and structure of the unidirectional cast article still needs improvement. There is a sensitive dependence of the mechanical properties on the grain structures of cast materials. The mechanical integrity of columnar single crystal and polycrystalline cast articles is dependent on the elimination of high-angle grain boundaries and equiaxed grains. Also, the cast articles having a length greater than about four inches, such as nozzles, buckets, or airfoils used in land-based turbine generators, generally exhibit substantial interdendrite segregation formed during the directional solidification process. Depending on the particular superalloy chemistry, the segregation can result in the formation of low melting point or brittle phases, non-uniform distribution of strengthening precipitates, interdendritic porosity, and surface freckles. The term "freckles" or "freckling" means that during solidification of superalloy columnar single crystal or polycrystalline cast articles chains of very small equiaxed grains form. It is proposed that in directional solidification, where the liquid melt is maintained above the solid, these chains of freckle type defects develop when segregating elements alter the liquid density of the interdendritic fluid to a sufficient degree to initiate a convective instability. One or more of these structural manifestation can be undesirable. Further, the methods for minimizing the presence or effects of dendrite segregation, including solid state diffusion heat treatments or mechanical working, are not feasible for use with complex alloys or large cast articles.

Dendrites formed within the columnar single crystal or polycrystalline article are distinguished from the surrounding material by differences in concentration of some constituents. Embedded particles and elemental microconstituents of the alloy chemistry tend to accumulate in the normally weaker interdendrite regions. As a result the strength of the cast alloy is decreased by such inhomogeneities. The size of the embedded particles and pools of the microconstituents is significantly reduced by a reduction in primary dendrite arm spacing in the cast article. The primary spacing is the average spacing between adjacent dendrite cores. Primary dendrite arm spacing is measured by sectioning normal to the crystal growth direction, counting the number of primary arms over the cross-sectional area, and calculating an average spacing. Typically, average spacing is determined assuming a square array. Secondary dendrite arm spacing is the average spacing between adjacent secondary dendrite arms as observed on a section containing the growth direction. Thus, there is a need to produce unidirectional cast articles with minimal primary and secondary dendrite arm spacing to achieve superior mechanical and chemical properties with decreased structural defects.

Dendrite arm spacing is also a measure of the solidification conditions of a casting. Dendrite arm spacing varies inversely with cooling rate (solidification rate times thermal gradient). High thermal gradients are required to prevent nucleation of new grains during directional solidification; high cooling rates are required to prevent freckle formation.

Hitachi, in U.S. Pat. No. 5,489,194, addresses the casting of single crystal nickel superalloy blades for turbines that are seven inches or greater in length. Hitachi obtains single crystal microstructure in a blade comprising a dovetail with a shank being connected to the dovetail and having one or more protrusions formed on the side of the dovetail, and with a vane being connected to the shank. Because of the use of protrusions in a by-pass mold, Hitachi forms a large single crystal blade. The casting process is performed in a conventional Bridgman furnace using a chill plate with radiant and convection cooling. However, Hitachi does not teach or suggest fine dendrite spacing in the single crystal blade. In fact, although Hitachi produces a large single crystal blade of about 160 mm (6–7 inches in length), the Hitachi single crystal structure is expected to have large dendrite arm spacing due to the low cooling rates of radiation from a mold to the walls of the furnace. Also, after casting the single crystal blade, Hitachi subjects the blade to a solution heat treatment, followed by an aging treatment. The various heat treatments take several hours. Hitachi's blade, while single crystal, still does not solve the problem of obtaining fine primary dendrite arm spacing to provide an homogeneous microstructure with improved mechanical properties in large cast articles. FIG. 1 shows a plot for dendrite arm spacing 40 versus the size of the cast article obtained by conventional casting methods such as used by Hitachi with vacuum radiation cooling.

Since Hitachi's blade is cast by the conventionally cooled method, the cooling rate or thermal gradient is a sensitive function of the size of the blade to be cast. As a general rule of thumb, the cooling rate or thermal gradient is inversely proportional to the blade size. When the size of the blade increases, the cooling rate and thermal gradient decreases, and the tendency of extraneous grain nucleation increases. The types of grain defects caused by the reduced cooling or thermal gradient in large blades include those known in the trade as freckles or slivers. These types of defects, once formed due to the reduced thermal gradient, are not restricted to protruded areas of the blade such as platform or angle wing. Due to this unpredictability, the by-pass mold designed to eliminate grain defects in the shank area, as discussed in the Hitachi patent, will not be effective in producing a totally defect-free large blade. Even with the by-pass mold, Hitachi's blade will be difficult to cast free of defects.

On the other hand, U.S. Pat. No. 3,915,761, discloses a superalloy cast blade for aircraft engines that is about four inches in length (col. 6, lines 5–6; col. 9, lines 23–24) with a hyperfine primary dendrite spacing of less than about 0.005 inches or 130 micrometers ($\mu$m). Herein, "hyperfine" primary dendrite spacing means average spacing less than 0.005 inches (130 $\mu$m) between adjacent dendrite cores. The hyperfine dendrite spacing is accomplished by using a casting method that utilizes a liquid cooling bath that provides a high solidification rate by withdrawal of the part from the furnace at about 120 inches per hour. This teaching is limited to aircraft size parts and has not been demonstrated for land-base turbine components. In fact, the size of land-base turbine parts prohibits the withdrawal rates used in '761.

U.S. Pat. No. 3,915,761 requires "hyperfine" primary dendrite spacing, attributes not achievable in large cast parts which are about seven inches in length or greater. This is partially due to the large size and its cross-section.

Large cast parts of defect-free columnar structures would be of great benefit for large gas turbines. For instance, consider the thermal efficiency of gas turbines as an important measurement of the performance of a power generation engine. An efficient engine is typically run at a high enough temperature so that the fuel energy can be effectively utilized to generate low cost electricity. New generations of power generators will require larger turbine capacity and component sizes. Blades that are twelve inches or greater will be required. However, a limitation of gas turbines is the availability of turbine articles that can sustain high temperature and stress in the engine environment. To cope with such an increase in the gas temperature, conventional cast articles, such as buckets, blades, nozzles, vanes, and airfoils have complicated geometry's and cooling holes. This further poses problems in the casting operations utilized to make the article as well as the ability to provide the required mechanical and chemical properties of the cast article.

For these reasons, there is a need for a large unidirectional solidified columnar cast article that is single crystal, polycrystalline, or a mixture of single and polycrystalline microstructure that is substantially defect free, without requiring the impractical hyperfine dendrite arm spacing 30 of U.S. Pat. No. 3,915,761 as displayed in FIG. 1. The fine dendrite arm spaces 50 shown in FIG. 2 in large unidirectional columnar cast articles provides improved chemical and mechanical properties of the cast article.

SUMMARY OF THE INVENTION

This invention satisfies the above need by providing a cast superalloy article having a unidirectional crystal structure that is substantially defect free with primary dendrite arm spacing greater than 150 $\mu$m. The unidirectional crystalline microstructure comprises a longitudinal columnar structure aligned parallel with the direction of solidification where said columnar structure is a single crystal or polycrystals or mixtures thereof. In other words, the invention is a directionally structured cast article of superalloy material having one or more continuous columnar longitudinal grains. The superalloy material used in the casting operation is preferably a substantially clean superalloy melt. This means that the molten superalloy material contains less than 0.5 weight percent impurities. For a cast article to be substantially defect free there are few or no casting defects present that affect the performance and overall properties of the cast superalloy article or that cause the article to be scrapped or reworked in order to be fit for its intended application. A substantially "defect free" cast superalloy article can also include articles where casting defects, such as freckles and slivers, are not present in lengths greater than 100 micrometers. Other types of casting defects that may be minimized in the cast article of this invention include freckles, equiaxed grains, slivers, low/high angle boundaries, and secondary-/multi-grains. Other defects caused by solidification conditions that are evidenced by large primary dendrite arm include the formation of low melting point or brittle phases, nonuniform distribution of strengthening precipitates and interdendritic porosity. The method of making the claimed article decreases the presence of these defects. Thus, the method of casting the articles is also perceived as part of the invention.

The primary dendrite arm spacing is measured as the space between the dendrite cores. The terms "fine dendrite spacing" or "fine dendrite arm spacing" or "primary dendrite arm spacing" mean that the average space between the dendrite cores is greater than or equal to 150 $\mu$m, but less than about 800 $\mu$m for corresponding articles having a cast article length between about four to about forty inches, respectively. To further explain, an article of this invention (made by the method of this invention) that has a cast length of about 7 inches would have a corresponding primary dendrite arm spacing between about 200 to 300 $\mu$m. The same part as manufactured by the prior art methods would have a primary dendrite arm spacing greater than 300 and up to or greater than 500 $\mu$m. Likewise, a cast article of this invention having a length of about 25 inches, would have a primary dendrite arm spacing between 200 to 700 $\mu$m. The same part cast by the prior art teachings would have a primary dendrite spacing of about 800 $\mu$m or greater.

The term "columnar" applied as a descriptive adjective to a casting herein means containing a macrostructure of one or more metal grains aligned along a given direction. The terms "columnar single crystal" or "single crystal" applied as a descriptive adjective to a casting mean containing a macrostructure of a single grain. The terms "columnar polycrystals" or "polycrystal" or "polycrystalline" applied as a descriptive adjective to a casting mean containing a macrostructure of more than one metal grains. A longitudinal columnar structure aligned parallel with the direction of solidification means a macrostructure of one or more metal grains aligned along a given direction.

In yet another aspect of the invention, there is provided a directionally solidified single crystal superalloy article having primary dendrite arm spacing between about 150 $\mu$m to less than 800 $\mu$m and a length from about four (4) inches to about forty (40) inches. The single crystal article is substantially defect free and has an essentially uniform microstructure throughout the article. By uniform microstructure is meant a microstructure whose general features—dendrite arm spacing, distribution of minor phases, such as borides and carbides, gamma prime content—are substantially the same in all areas of the casting. The preferred single crystal direction is <001>. However, crystalline structures of other orientations than <001> are also included in this invention.

The invention further provides a high gradient, directionally solidified cast article comprising superalloy metal having a single crystal longitudinal columnar structure parallel to the direction of solidification with primary dendrite spacing of at least 150 $\mu$m. The length of the high gradient cast article can be up to about 40 inches.

Still another aspect of the invention is a directionally solidified component for a gas turbine, such as a blade, nozzle, bucket, vane, or airfoil comprising a single crystal superalloy metal being substantially free of defects, having a primary dendrite arm spacing of at least 150 μm and a component length up to and including about 40 inches. Also included as part of the invention is a directionally solidified component for a gas turbine comprising polycrystalline superalloy metal having columnar structure parallel to the direction of solidification being substantially defect free with a primary dendrite arm spacing of at least 150 μm and a component length up to and including 40 inches. The substantially defect free article may be substantially free of freckle defects. The cast articles and components of the invention may further include environmental and thermal protective coatings. Such coatings include but are not limited to, nickel aluminide, platinum or palladium aluminide, a metal coating of chromium, aluminum, yttrium with a metal selected from the group consisting of nickel, iron, cobalt, and mixtures thereof (known in the art as MCrAlY coatings), ceramic coatings, such as a chemically stabilized oxide coating or partially-stabilized oxide coating, and mixtures of these coatings.

Another aspect of the invention is a gas turbine comprising a turbine disk; at least one stage of a turbine blade connected to the disk, said blade having an overall length greater than about four inches, being made of a high gradient cast unidirectional solidified superalloy metal having a columnar single crystal or polycrystal structure or a mixture thereof with a primary dendrite arm spacing of at least 150 μm; and a turbine nozzle in correspondence to the turbine blade, said nozzle having an overall length greater than about four inches, being made of a high gradient cast unidirectional solidified superalloy metal having a columnar single crystal or polycrystal structure with a primary dendrite arm spacing of at least 150 μm. The invention also is directed towards a turbine blade, nozzle, bucket, vane and airfoil comprising a superalloy metal cast as a columnar single crystal with crystallographic direction of <001> having a primary dendrite arm spacing "X", where 150 μm $\leqq X < 800$ μm for blade, nozzle, bucket, vane and airfoil lengths greater than or equal to four inches to forty inches. The cast articles of this invention are substantially defect free, preferably free of freckles greater than 100 μm in length. The invention further provides a heavy-duty gas turbine comprising a compressor, a combustion liner, a turbine blade, in a single stage or multi-stages, which has a dovetail secured to a turbine disk where said blade has an overall length between about four and forty inches, is made of a superalloy metal columnar single crystal or columnar polycrystals or mixtures thereof, having primary dendrite arm spacing of at least about 150 μm. A turbine nozzle is provided in correspondence to the turbine blade, wherein a maximum operating gas temperature is not less than 1000° C., and maximum metal temperatures of a first blade is not less than 900° C. under working stress.

The present invention also relates to a gas turbine comprising an arrangement of blades and nozzles, each blade having a vane part, a platform, and a shank part and each nozzle having a vane part and platform, wherein each blade provided at a disk is rotated by allowing a compressed combustion gas to pass through a nozzle and to collide against a blade in which the temperature of the combustion gas is 1000° C. or higher, temperature of the combustion gas at an inlet for a vane part of a blade of a first stage is at least 1000° C., the blade of the first stage is a columnar single crystal, has a length of at least four inches, and a primary dendrite arm spacing of at least 150 μm. The surface of a vane part of at least one blade and nozzle is covered with an environmental and thermal protective coating.

In another aspect of the invention is provided a method of making a directionally solidified columnar single crystal or columnar polycrystalline article comprising the steps of: pouring a molten superalloy metal in a heated zone into a preheated mold comprising a main cavity having the shape of the cast article; withdrawing the mold with the molten superalloy metal from the heated zone into a liquid cooling tank at a withdrawal rate sufficient to solidify the molten metal to form primary dendrite arm spaces greater than or equal to 150 μm but less than 800 μm corresponding to a length of the cast article between about 4 to about 40 inches, respectively; and subsequent cooling of the mold to effect the columnar single crystallization or columnar polycrystallization that is substantially defect free. Part of the invention includes the articles made by this process. The manufacturing method for the cast article, according to this invention, is capable of manufacturing a large part, greater than seven inches and up to about 40 inches in length having a single crystal structure that is substantially defect free with fine dendrite arm spacing (about 150 to less than 800 μm).

Because the dendrite arm spacing is fine and the directionally solidified article is substantially defect free, the cast article of this invention has more strength and better mechanical properties than a cast article with large dendrite spacing accompanied with interdendrite pools of non-homogeneous distribution of the superalloy constituents. The fine dendrite arm spacing is not accomplished by traditional casting methods used by those skilled in the art. Typical primary dendrite arm spaces for a cast part of 7 inches is around 300–400 μm made by prior art methods. For larger parts, the dendrite spaces easily exceed 800 μm. Thus, the fine dendrite spacing achieved in this invention, even in large cast parts up to about 40 inches, removes many of the inhomogeneities of the chemical composition of the cast article and strengthens the article itself, including high temperature strength. This provides longer service life of the article. The gas turbine of this invention is more efficient because the cast superalloy articles with fine primary dendrite arm spacing have fewer defects, and thus better mechanical properties. The cast articles have longer life which provides more reliability to the gas turbine.

BRIEF DESCRIPTION OF THE DRAWINGS

FIG. 1 also shows the hyperfine dendrite arm spacing for 4 inch aircraft blades manufactured using a liquid cooling bath, as shown in U.S. Pat. No. 3,915,761.

DETAILED DESCRIPTION OF THE INVENTION

Figure 1:
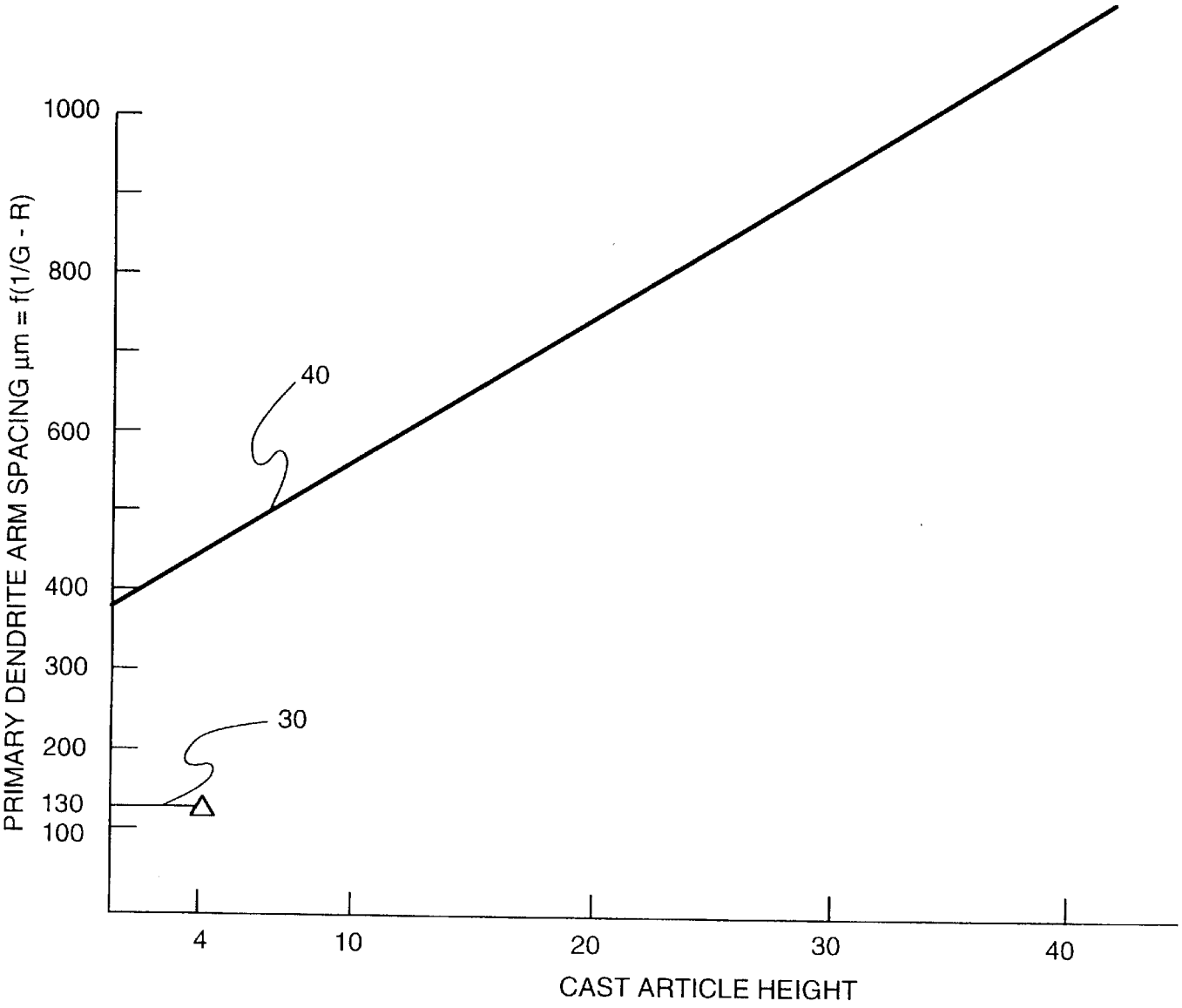
FIG. 1 is a plot of the prior art primary dendrite arm spacing in micrometers (μm) vs. cast article length for articles made using conventional radiation cooling.

We have discovered solidification process conditions, as evidenced by dendrite arm spacing, that are required to prevent casting defects in castings of great length, larger than about four inches. These conditions are unexpected from prior art work on castings four inches or smaller.

The unidirectionally cast article of the invention has a columnar single crystal or columnar polycrystalline microstructure that further has a primary dendrite arm spacing of at least 150 $\mu$m and is substantially defect free. The cast article is made from a molten superalloy material. The superalloy can be a nickel-base, cobalt-base, or iron-base superalloy, preferably being a nickel-base or cobalt-base superalloy, and most preferably being a nickel-base superalloy. Tables 1 and 2 give examples of compositions of nickel-base superalloys. An example of a preferred nickel-base superalloy composition is the Rene N5 alloy.

TABLE I

| Alloy | Ni | Cr | Co | Al | Ti | Mo | W | Ta | Nb | Other |
|---|---|---|---|---|---|---|---|---|---|---|
| GTD222 | Bal. | 22.5 | 19.0 | 1.2 | 2.3 | — | 2.0 | 1.0 | 0.8 | 0.010 C.<br>0.005–0.04 Zr<br>0.002–0.015 B |
| GTD111 | Bal. | 14.0 | 9.5 | 3.0 | 4.9 | 1.5 | 3.8 | 2.8 | — | 0.010 C<br>0.0–0.04 Zr<br>0.002–0.020 B |
| Rene'80 | Bal. | 14.0 | 9.5 | 3.0 | 5.0 | 4.0 | 4.0 | — | — | 0.017 C<br>0.03 Zr<br>0.015 B |
| Nim263 | Bal. | 20.0 | 20.0 | 0.45 | 2.15 | 5.7 | — | — | — | 0.06 C |
| IN738 | Bal. | 16.0 | 8.5 | 3.5 | 3.5 | 1.75 | 2.6 | 1.75 | 0.85 | 0.175 C<br>0.10 Zr<br>0.010 B |
| Waspaloy | Bal. | 19.5 | 13.5 | 1.4 | 3.1 | 4.2 | — | — | — | 0.06 C<br>0.04 Zr max<br>0.006 B |
| Rene'41 | Bal. | 19.0 | 11.0 | 1.5 | 3.1 | 10.0 | — | — | — | 0.09 C<br>0.005 B |
| Rene'142 | Bal. | 6.8 | 12.0 | 6.15 | — | 1.5 | 4.9 | 6.35 | — | 2.8 Re<br>1.5 Hf<br>0.12 C<br>0.015 B<br>0.01 Y |
| Rene'N4 | Bal. | 9 | 8 | 3.7 | 4.2 | 2 | 6.0 | 4.0 | 0.5 | — |
| Rene'N4+ | Bal. | 9.75 | 7.5 | 4.2 | 3.5 | 1.5 | 6.0 | 4.8 | 0.5 | 0.15 Hf<br>0.05 C<br>0.004 B |
| Rene'N5 | Bal. | 7.0 | 8 | 6.2 | — | 2 | 5.0 | 7 | — | 0.2 Hf<br>0.05 C<br>0.004 B<br>3 Re |
| R'Nb | Bal. | 4.25–6 | 10–15 | 5–6.25 | — | 0.5–2 | 5–6.5 | 7–9.25 | 0–1 | 5.1–5.6 Re<br>0.1–0.5 Hf |

TABLE 2

| Alloy | Ni | Cr | Co | Mo | W | Ta | Cb | Al | Ti | Fe | Mn | Si | C | B | Zr | Others |
|---|---|---|---|---|---|---|---|---|---|---|---|---|---|---|---|---|
| Alloy 713C | 74 | 12.5 | 0.0 | 4.2 | 0.0 | 0.0 | 2.0 | 6.1 | 0.8 | 0.0 | 0.0 | 0.0 | 0.12 | 0.012 | 0.10 | |
| Alloy 713LC | 75 | 12.0 | 0.0 | 4.5 | 0.0 | 0.0 | 2.0 | 5.9 | 0.6 | 0.0 | 0.0 | 0.0 | 0.05 | 0.010 | 0.10 | |
| B-1900 | 64 | 8.0 | 10.0 | 6.0 | 0.0 | 4.0 | 0.0 | 6.0 | 1.0 | 0.0 | 0.0 | 0.0 | 0.10 | 0.015 | 0.10 | |
| C-1023 | 58 | 15.5 | 10.0 | 8.5 | 0.0 | 0.0 | 0.0 | 4.2 | 3.6 | 0.0 | 0.0 | 0.0 | 0.16 | 0.006 | 0.00 | |
| CMSX-2 | 66 | 8.0 | 4.6 | 0.6 | 7.9 | 5.8 | 0.0 | 5.6 | 0.9 | 0.0 | 0.0 | 0.0 | 0.00 | 0.000 | 0.00 | |
| GMR-235 | 63 | 15.5 | 0.0 | 5.3 | 0.0 | 0.0 | 0.0 | 3.0 | 2.0 | 10.0 | 0.3 | 0.6 | 0.15 | 0.060 | 0.00 | |
| IN-100 | 60 | 10.0 | 15.0 | 3.0 | 0.0 | 0.0 | 0.0 | 5.5 | 4.7 | 0.0 | 0.0 | 0.0 | 0.18 | 0.014 | 0.06 | 1.0 V |
| In-731 | 67 | 9.5 | 10.0 | 2.5 | 0.0 | 0.0 | 0.0 | 5.5 | 4.6 | 0.0 | 0.0 | 0.0 | 0.18 | 0.015 | 0.06 | 1.0 V |
| IN-738LC | 61 | 16.0 | 8.5 | 1.7 | 2.6 | 1.7 | 0.9 | 3.4 | 3.4 | 0.0 | 0.0 | 0.0 | 0.11 | 0.010 | 0.05 | |
| IN-939 | 48 | 22.5 | 19.0 | 0.0 | 2.0 | 1.4 | 1.0 | 1.9 | 3.7 | 0.0 | 0.0 | 0.0 | 0.15 | 0.009 | 0.09 | |
| IN-792 | 61 | 12.4 | 9.0 | 1.9 | 3.8 | 3.9 | 0.0 | 3.1 | 4.5 | 0.0 | 0.0 | 0.0 | 0.12 | 0.020 | 0.10 | |
| M22 | 71 | 5.7 | 0.0 | 2.0 | 11.0 | 3.0 | 0.0 | 6.3 | 0.0 | 0.0 | 0.0 | 0.0 | 0.13 | 0.000 | 0.60 | |
| MM-002 (RR-7080) | 61 | 9.0 | 10.0 | 0.0 | 10.0 | 2.5 | 0.0 | 5.5 | 1.5 | 0.0 | 0.0 | 0.0 | 0.14 | 0.015 | 0.05 | 1.5 Hf |
| MM-004 (IN-713 + Hf) | 74 | 12.0 | 0.0 | 4.5 | 0.0 | 0.0 | 2.0 | 5.9 | 0.6 | 0.0 | 0.0 | 0.0 | 0.05 | 0.015 | 0.05 | 1.3 Hf |
| MM-005 (Rene'125 + Hf) | 59 | 8.5 | 10.0 | 2.0 | 8.0 | 3.8 | 0.0 | 4.8 | 2.5 | 0.0 | 0.0 | 0.0 | 0.11 | 0.015 | 0.05 | 1.4 Hf |
| MM-005 (MAR-M 246 + Hf) | 63 | 9.0 | 10.0 | 2.5 | 10.0 | 1.5 | 0.0 | 5.5 | 1.5 | 0.0 | 0.0 | 0.0 | 0.14 | 0.0015 | 0.05 | 1.8 Hf |

TABLE 2-continued

| Alloy | Ni | Cr | Co | Mo | W | Ta | Cb | Al | Ti | Fe | Mn | Si | C | B | Zr | Others |
|---|---|---|---|---|---|---|---|---|---|---|---|---|---|---|---|---|
| MM-009 (MAR-M 200 + Hf) | 59 | 9.0 | 10.0 | 0.0 | 12.5 | 0.0 | 1.0 | 5.0 | 2.0 | 0.0 | 0.0 | 0.0 | 0.14 | 0.015 | 0.05 | 1.8 Hf |
| MM-0011 (MAR-M 247) | 60 | 8.3 | 10.0 | 0.7 | 10.0 | 3.0 | 0.0 | 5.5 | 1.0 | 0.0 | 0.0 | 0.0 | 0.14 | 0.015 | 0.05 | 1.5 Hf |
| MAR-M 421 | 61 | 15.8 | 9.5 | 2.0 | 3.8 | 0.0 | 2.0 | 4.3 | 1.8 | 0.0 | 0.0 | 0.0 | 0.14 | 0.015 | 0.05 | |
| PWA 1480 | 63 | 10.0 | 5.0 | 0.0 | 4.0 | 12.0 | 0.0 | 5.0 | 1.5 | 0.0 | 0.0 | 0.0 | 0.00 | 0.000 | 0.00 | |
| Rene'77 | 58 | 14.6 | 15.0 | 4.2 | 0.0 | 0.0 | 0.0 | 4.3 | 3.3 | 0.0 | 0.0 | 0.0 | 0.07 | 0.016 | 0.4 | |
| Rene'80 | 60 | 14.0 | 9.5 | 4.0 | 4.0 | 0.0 | 0.0 | 3.0 | 5.0 | 0.0 | 0.0 | 0.0 | 0.17 | 0.015 | 0.03 | |
| SEL | 51 | 15.0 | 22.0 | 4.5 | 0.0 | 0.0 | 0.0 | 4.4 | 2.4 | 0.0 | 0.0 | 0.0 | 0.08 | 0.015 | 0.00 | |
| SEL-15 | 58 | 11.0 | 14.5 | 6.5 | 1.5 | 0.0 | 0.5 | 5.4 | 2.5 | 0.0 | 0.0 | 0.0 | 0.07 | 0.015 | 0.00 | |
| SRR-99 | 66 | 9.0 | 5.0 | 0.0 | 9.5 | 2.9 | 0.7 | 5.5 | 1.8 | 0.0 | 0.0 | 0.0 | 0.03 | 0.000 | 0.00 | |
| TRW-NASA VIA | 61 | 6.1 | 7.5 | 2.0 | 5.8 | 9.0 | 0.5 | 5.4 | 1.0 | 0.0 | 0.0 | 0.0 | 0.13 | 0.020 | 0.13 | 0.4 Hf, 0.5 Re |
| Udimet 500 | 52 | 18.0 | 19.0 | 4.2 | 0.0 | 0.0 | 0.0 | 3.0 | 3.0 | 0.0 | 0.0 | 0.0 | 0.07 | 0.007 | 0.5 | |
| UDM56 | 64 | 16.0 | 5.0 | 1.5 | 6.0 | 0.0 | 0.0 | 4.5 | 2.0 | 0.0 | 0.0 | 0.0 | 0.02 | 0.070 | 0.03 | 0.5 V |

Table 3 gives further examples of cobalt-base superalloy compositions. In another aspect of the invention, a cast article may be achieved by utilizing a superalloy composition that contains as little titanium, niobium, zirconium, tungsten, rhenium, and boron as needed for mechanical properties, but as much hafnium, tantalum and carbon as possible while maintaining phase stability in the cast article.

TABLE 3

| Alloy | Ni | Cr | Co | Mo | W | Ta | Cb | Al | Ti | Fe | Mn | Si | C | B | Zr | Others |
|---|---|---|---|---|---|---|---|---|---|---|---|---|---|---|---|---|
| FSX-414 | 10 | 29.0 | 52.0 | 0.0 | 7.5 | 0.0 | 0.0 | 0.0 | 0.0 | 1.0 | 0.0 | 0.0 | 0.25 | 0.010 | 0.00 | |
| MAR-M 302 | 0 | 21.5 | 58.0 | 0.0 | 10.0 | 9.0 | 0.0 | 0.0 | 0.0 | 0.0 | 0.0 | 0.0 | 0.85 | 0.005 | 0.20 | |
| MAR-M 509 | 10 | 23.5 | 55.0 | 0.0 | 7.0 | 3.5 | 0.0 | 0.0 | 0.2 | 0.0 | 0.0 | 0.0 | 0.60 | 0.000 | 0.50 | |
| WI-52 | 0 | 21.0 | 63.0 | 0.0 | 11.0 | 0.0 | 2.0 | 0.0 | 0.0 | 2.0 | 0.3 | 0.3 | 0.45 | 0.000 | 0.00 | |
| X-40/X-45 | 10 | 252.5 | 54.0 | 0.0 | 7.5 | 0.0 | 0.0 | 0.0 | 0.0 | 0.0 | 0.7 | 0.7 | 0.50 | 0.000 | 0.00 | |

A key feature and advantage of the claimed invention is the substantially defect free cast structure. This is achieved by the fine primary dendrite arm spacing and the casting techniques employed while making the article. Generally, defects such as low melting point or brittle phases, nonuniform distribution of strengthening precipitates, interdendritic porosity, and surface freckles are attributed to the interdendritic regions between primary dendrite cores or arms that allow pools of inhomogeneous elemental constituents to collect. Achieving fine primary dendrite arm spacing in large size cast articles eliminates many of these defects. The primary dendrite arm spacing (herein DAS) is preferably about 150 $\mu$m for a 4 inch length cast part and preferably about 220 $\mu$m for a seven inch part, although below 220 $\mu$m DAS can also be achieved for a seven inch part, as can DAS above 220 $\mu$m.

Figure 2:
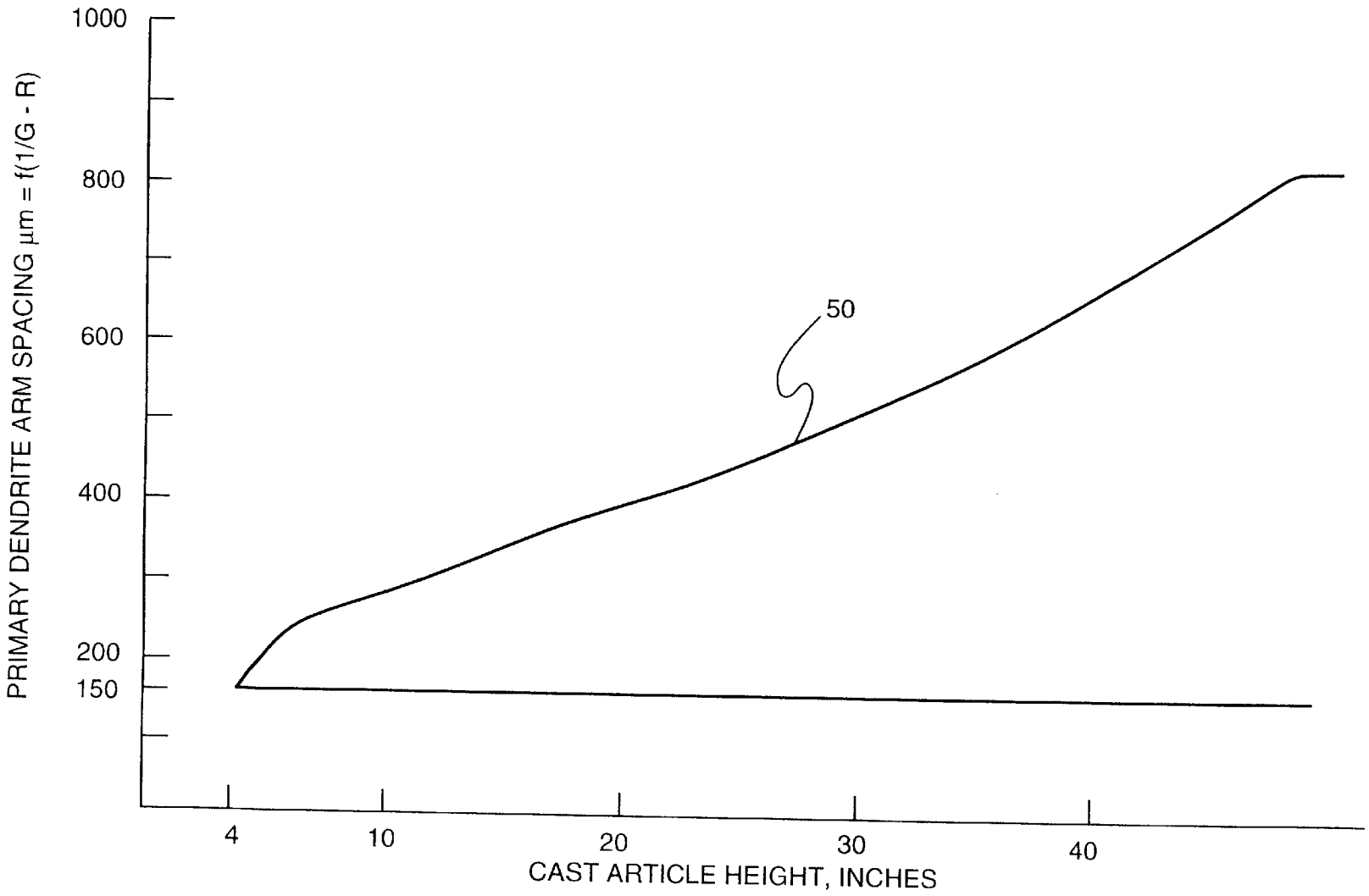
FIG. 2 is a plot depicting fine primary dendrite arm spacing (μm) versus the cast article length (inches) for the claimed articles made by the method of this invention.

A unique aspect and unexpected result of this invention is that larger size cast articles, such as turbine blades, having an overall length of between 25–40 inches, can be manufactured having fine dendrite arm spacing, such as between about 150 to less than 800 $\mu$m. This is unexpected because similar size conventional cast articles obtain dendrite arm spacing around 800 $\mu$m and higher. These articles also have casting defects which often require long hours of heat treatment, which is not always practical and further can be costly. Turning to FIG. 2 there is depicted a region showing a preferred primary dendrite arm spacing 50 for articles of this invention.

Figure 3B:
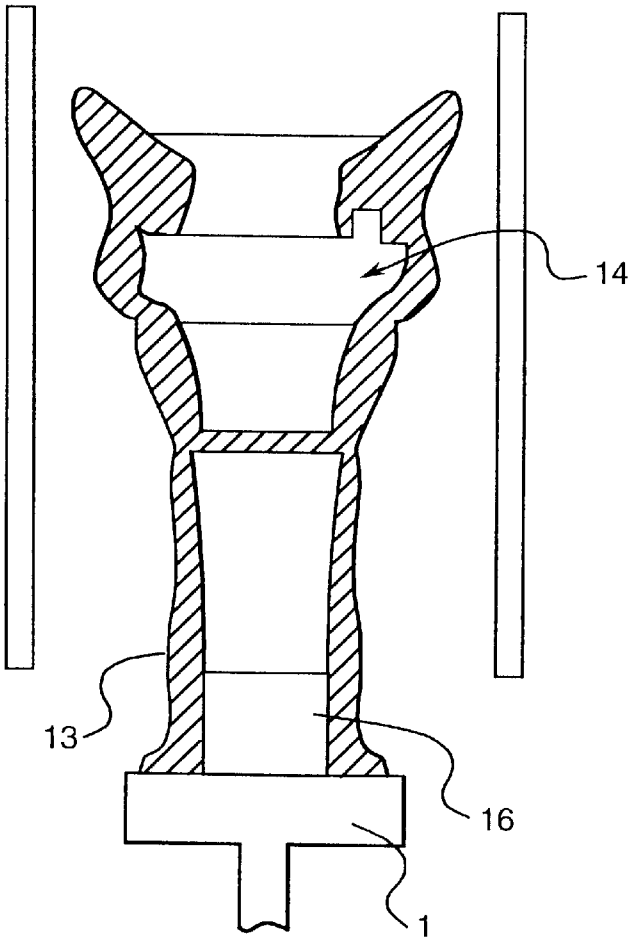
FIG. 3*b* is a vertical cross section of a mold having a grain path illustrative of a manufacturing method for a large columnar polycrystal cast article.
Figure 3A:
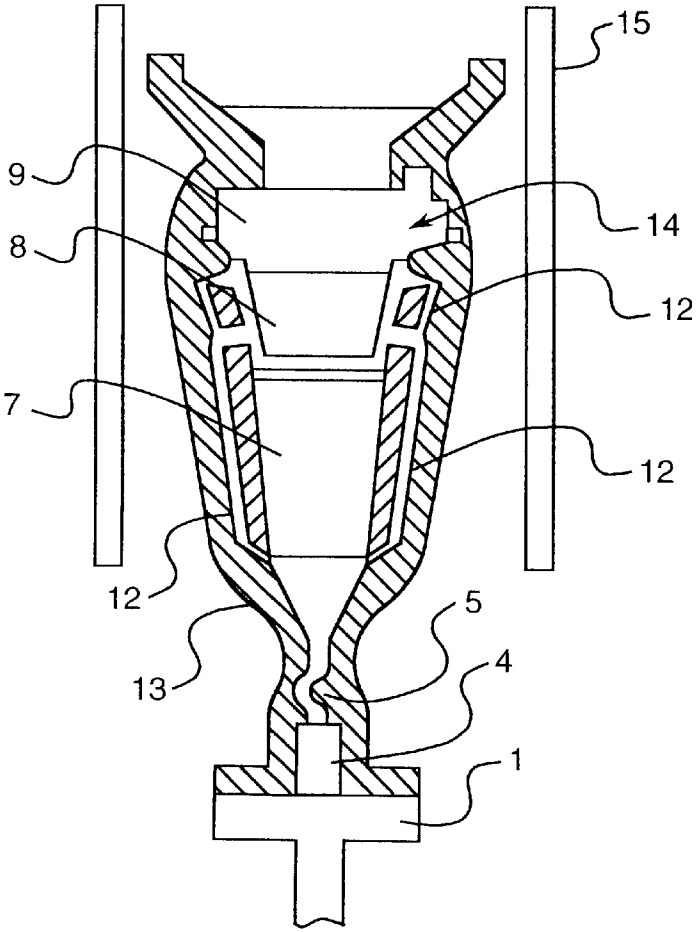
FIG. 3*a* is a vertical cross section of a mold having a grain selector illustrative of a manufacturing method for a large columnar single crystal cast article, such as a turbine rotor blade or bucket.

As stated previously, the article of this invention is substantially defect free. One casting defect that is minimized is high angle boundaries that tend to form at protruded sections of the cast articles where preferred cooling may lead to unwanted nucleation of misoriented grains. One way to eliminate the high angle boundaries is to create a grain path that is not a part of the cast article. A direct bridge 12 can be created to connect the protruding sections of the casting to a bottom section in the casting mold, as shown in FIGS. 3*a* and 3*b*. The grain path has a shape of a bar or plate, which enables the controlled directional solidification of the columnar crystals to be propagated to extruded sections of the casting before any extraneous grain nucleation occurs.

A separate type of grain defect that frequently leads to rejection in the production of directionally solidified columnar single crystal or columnar polycrystals is known as "freckles". Unlike the high angle boundaries, freckles form partially as a result of molten metal convection in the casting mold which disrupts the solidification process. This can produce the notorious irregularities seen on the surfaces of cast articles, such as little chains of equiaxed crystals. To avoid freckle formation requires adjustments in the thermal and chemical conditions of the casting article. Adjustments in the alloy chemistry may be employed to decrease the formation of freckles. This invention controls the chemical constituents of the alloy during casting by the formation of fine dendrite arm spacing. The fine DAS prevents pools of inhomogeneous constituents from forming in the interdendritic regions of the cast article. The thermal gradient conditions employed equally across the cross-section of the cast article further help to reduce the DAS in the article and thus reduce freckle formation. During the course of the making of this invention, it has been discovered that there is a process window where freckle formation is decreased which may be article length and DAS dependent. For casting lengths greater than four inches and preferably greater than eight inches, freckles are decreased with fine dendrite arm spacing between 150 to less than 800 $\mu$m based on the length of the cast article.

Slivers are grains forming streaks in the microstructure. They are usually aligned close to the primary direction of the casting, but are misoriented in the transverse direction. By using a super clean melt for the molten superalloy, slivers are less likely to form from inclusions in the superalloy material.

Secondary and multi-grains usually occur when more than one grain emerges from the grain selector at the base of the mold. Heat transfer conditions during the solidification of the casting are controlled so that one section of the casting article does not cool faster than the rest of the casting. This eliminates the nucleation and formation of secondary grains from the melt in competition with the primary columnar single crystal. Secondary and multi-grains are controlled by adjusting the heat transfer conditions during the withdrawal of the mold into the cooling bath or radiation cooling zone. This ensures that all parts of the casting cool at the same rate.

Referring to FIG. 3*a* there is shown a shell mold 13 made of a suitable material such as alumina or silica. The mold 13 is constructed to the shape of the casting 14, for example, a turbine blade. The mold 13 may be secured to a chill plate. The mold 13 is placed in a heating zone 15 to heat the mold. The mold 13 is heated to a temperature not less than the melting temperature of the superalloy to be cast, and is preferred to be heated above the liquidus temperature of the superalloy. A molten superalloy, such as a nickel-base or cobalt-base superalloy composition, is poured into the preheated mold 13. The base of the mold or the water cooled chill plate 1 is withdrawn downwardly at a fixed rate to the cooling zone (a liquid metal cooling bath or in vacuum or ambient/cooled air for radiation cooling) to solidify the superalloy by a unidirectional solidification process. Crystals are first formed in the starter 4 at the base of the mold 13 and are then formed into one single crystal in a crystal selector 5. The single crystal selector 5 is capable of rotating while the crystal is forming. The crystal selector 5 may be a helix defining therein a helical passage for selecting a single crystal to grow into the article portion. The columnar single crystal becomes larger in the enlarged section of the casting 14. By controlling steep, uniform thermal gradients throughout the casting during the cooling, the columnar single crystal is formed in the casting 14 that is substantially defect free with primary dendrite arm spacing greater than 150 $\mu$m and less than 800 $\mu$m corresponding to cast article lengths between 4 and 40 inches, respectively. A preferred primary dendrite arm spacing is between about 150 $\mu$m and 650 $\mu$m, and a most preferred spacing is between about 150 $\mu$m and 350 $\mu$m. In FIG. 3*a* the casting 14 represents parts of a turbine blade, comprising an airfoil 7 having cooling passages formed therein, a shank 8 connected to the airfoil 7, and a dovetail 9 connected to the shank 8. The blade can be cast from the airfoil 7 first or the dovetail 9 first, depending on the structure of the mold 13. A bridge 12 connects the protruding sections of the casting 14 with the lower sections of the casting so that a unidirectional columnar single crystal forms substantially throughout the casting 14. The cast article is substantially columnar single crystal throughout the casting when more than 50% of the cast article is single crystal.

In another mold embodiment displayed in FIG. 3*b*, the portion of the mold is shown which is adapted for making columnar polycrystals instead of substantially columnar single crystals. To do this, the mold 13 has a growth zone 16 or starter 16 at the base of the mold 13 open to the chill plate 1. The crystal selector of FIG. 3*a* is omitted.

Crystalline structures of other orientations than <001> may be made by the methods of this invention. In this arrangement, the growth zone receives a single crystal slug of the desired orientation and the base of the slug is preferably set into a recess in the support plate so that this slug will not be totally melted during the heating of the mold. When the superalloy is poured into the mold, columnar single crystal or columnar polycrystals occur with the dendrite orientation throughout the cast article the same as that of the slug.

The article to be cast is made in a mold, such as shown in FIGS. 3*a* and 3*b* which rests on a support plate, which can also be a chill plate. The mold is initally in a heating chamber, surrounded by a susceptor which in turn is surrounded by heating elements, such as coils. Positioned below the heating chamber is a tank which holds a cooling liquid bath, such as a liquid metal. The tank may have heating elements around it for raising the temperature of the cooling liquid to the desired temperature for immersion of the heated mold therein and the cooling chamber is also preferable surrounded with cooling coils. Suitable stirring means may be provided to assure circulation of the liquid bath. The stirring means and the heating and cooling coils around the tank serve to create and strengthen convective currents in the liquid cooling bath to help maintain a constant temperature differential between the mold and the portion of the bath in which the mold is being immersed.

Particular suitable cooling liquids for use in the tank include tin and aluminum. Tin is especially preferred because of its low melting temperature and low vapor pressure. A suitable temperature for the tin bath is between about 235–350° C.

Between the heating chamber and the tank with the cooling liquid is a baffle. The baffle is situated to be in close contact with the cooling liquid and the bottom of the heating chamber. The purpose of the baffle is to further aid in obtaining a steep thermal gradient between the superheated mold and the cooling liquid bath. The baffle may be a single layer or multiple layers comprising stiff or flexible thermal insulating material. The baffle may be rigid or may float. It further can be designed to vary its fit around the shape of the mold as it is withdrawn from the heating chamber, through the baffle and into the liquid cooling bath.

The process is preferably carried out in a vacuum or an inert atmosphere. An ambient air atmosphere can be used alone or in conjunction with the above as a form of cooling the mold after withdrawal from the heating chamber.

In one method of this invention the directional solidification process is initiated by charging preheated ceramic molds with superalloy, superheating to the range of about 1450 to 1600 C. The molds are preheated above the superalloy's liquidus temperature. The solidification and the formation of the columnar single crystal or polycrystalline structure is controlled by the withdrawal of the mold from the hot section of the furnace through a radiation baffle and into a liquid metal cooling bath. The temperature of the the support plate or chill plate is kept near the temperature of the cooling medium (liquid coolant or convection radiation cooling), dendritic growth begins within the growth zone of the mold and as solidification continues upward through the growth zone of the mold, the grain structure becomes columnar single crystal or columnar polycrystalline or a mixture thereof. Since the coolant medium is in contact with all the outer surfaces of the mold, it completely surrounds the mold and rapidly removes heat from all portions of the mold to aid with the solidification of the alloy in a longitudinal direction. Withdrawing through a radiation baffle serves to maintain steep thermal gradients at the solidification front in the mold. Uniform primary dendrite arm spacings are obtained by the strong unidirectional thermal gradients imposed on the casting. Generally, grain defects are decreased or eliminated when the thermal gradients are greater than about 10–12° C./cm. Higher thermal gradients than 10–12° C./cm are utilized in this invention.

EXAMPLES

A set of experiments were conducted using liquid metal cooling method of casting and the conventional radiation cooling to show the decrease in freckle formation and find dendrite arm spacing achieved in the cast articles of this invention.

Examples 1–3

The molds had a length of 150 millimeters (mm) long by 40 mm wide. The superalloy composition was a nickel base alloy, tradename Rene N5 (about 7.5 weight percent Co, 7.0 weight percent Cr, 6.2 weight percent Al, 6.5 weight percent Ta, 1.5 weight percent Mo, 5.0 weight percent W, 3.0 weight percent Re, the balance Ni with minor dopings of Hf, Y, B, and C). The casting furnace temperature was set at about 1500° C., the withdrawal rate was 2 millimeters per minute (mm/min), and the mold thickness was 12 layers of ceramic shell. These conditions were kept the same for casting runs where the mold was either 1.) withdrawn from the furnace and into a vacuum chamber space to be cooled by radiation cooling (conventional method) or 2.) withdrawn into a bath of liquid metal (tin) to be cooled by the liquid metal. After the casting, the cooling rates were calculated from thermocouple measurements. The primary dendrite arm spacings in the castings were measured by metallography, and evidence of freckling was examined by macro-etching the cast surface, followed by metallographic examination.

Figure 4:
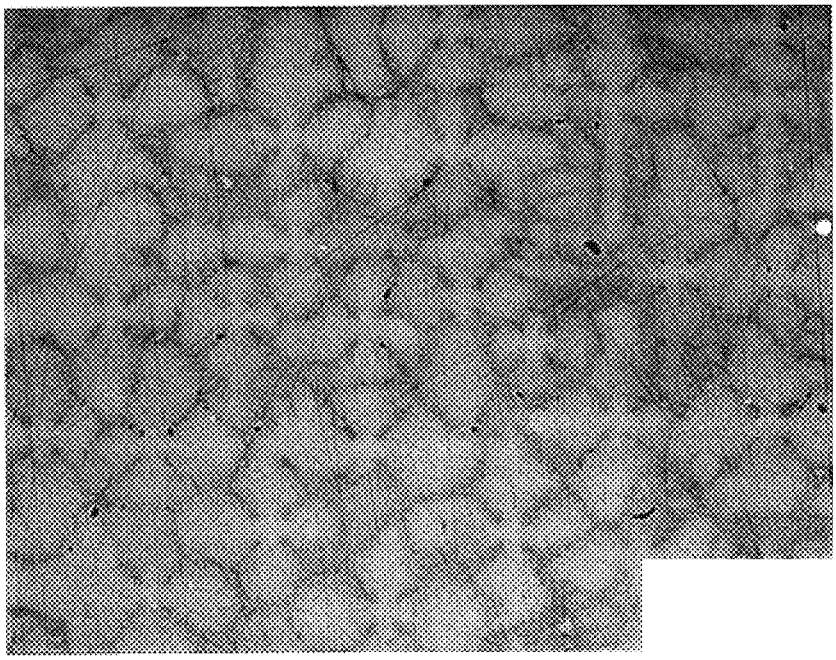
FIG. 4 is a photomicrograph of a prior art cast article at 100X having a primary dendrite arm spacing of about 388 $\mu$m and being 7 inches in length.
Figure 5:
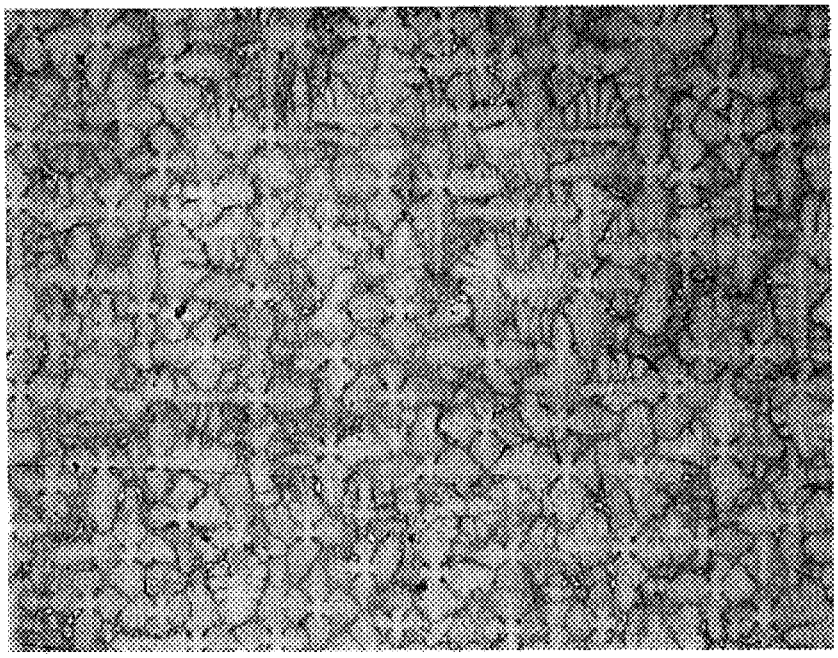
FIG. 5 is a photomicrograph of the claimed cast article of this invention at 100X having a primary dendrite arm spacing of about 217 $\mu$m and being 7 inches in length.

The results of the experiments are summarized in Table 4. The surfaces of the radiation cooled examples 1 and 2 showed freckle chains, which first appeared along the edges in the thin sections of the casting and then extended more pronouncedly into the flat surfaces of the thick sections. The primary dendrite arm spacing in these freckled castings were measured to be in the range between about 385–670 μm, FIG. 4. The thermal gradients were calculated for examples 1 and 2 to be between about 10–12 degrees centigrade per centimeter (C/cm). In contrast, the liquid metal cooled example 3, cast under the same conditions as examples 1 and 2, showed no evidence of freckles. The primary dendrite arm spacing in this freckle free casting showed a refinement with DAS in the range of 215–260 μm, FIG. 5. The thermal gradients were in the range of 40–65 C/cm, representing a 3 to 5 times improvement over the corresponding radiation cooled castings of examples 1 and 2.

TABLE 4

Casting Conditions and Results

| Conditions/Results | Example 1 | Example 2 | Example 3 |
|---|---|---|---|
| Furnace Temperature ° C. | 1585 | 1460 | 1580 |
| Withdrawal Rate mm/min | 2 | 2 | 2 |
| Mold shell layers | 12 | 12 | 12 |
| Cooling Scheme | radiation | radiation | liquid tin |
| Dendrite Arm Spacing μm | 385–620 | 570–670 | 215–260 |
| Thermal Gradient C/cm | 110–11 | 11–12 | 40–65 |
| Freckle Formation | yes | yes | no |

Example 4

In another set of experiments, comparison of freckle formation in radiation cooled cast parts versus liquid metal cooled cast parts was carried out. The molds were 470 mm in length and contained about 12 kilograms of metal. Casting conditions similar to examples 1–3 were employed. The freckle formation was again present in the radiation cooled part with freckle prevention was displayed in the liquid metal cooled part.

Example 5–6

A directional cast article (example 5) is made where the total initial length of molten metal is four inches (10 cm). The casting is directionally solidified at a casting rate of 6 inches per hour (15 cm/hr) in a conventional "Bridgman" furnace where the thermal gradient at the solid-liquid interface is 10° C./cm. The casting has freckles present and has a primary dendrite arm spacing about 350 μm.

A directional cast article (example 6) is made where the total initial length of molten metal is four inches (10 cm). This casting is directionally solidified at a casting rate of eight inches per hour (20 cm/hr) in a high gradient furnace using liquid metal cooling, where the thermal gradient at the solid-liquid interface is 80° C./cm. The casting is made defect-free (no freckles) and the primary dendrite arm spacing is about 150–230 μm.

Examples 7–8

A casting (example 7) is made where the total initial length of molten metal is about thirty inches (75 cm). This casting is directionally solidified at a casting rate of six inches per hour (15 cm/hr) in a Bridgman furnace where the thermal gradient at the solid-liquid interface is 10° C./cm. The primary dendrite arm spacing is about 800μm and the casting contains freckles.

A casting (example 8) is made where the total initial length of molten metal is thirty inches (75 cm). This casting is directionally solidified at a casting rate of eight inches per hour (20 cm/hr) in a high gradient furnace using liquid metal cooling, where the thermal gradient at the solid-liquid interface is 80° C./cm. The casting is defect free with no freckles and the primary dendrite arm spacing is 250–350 μm.

What is claimed is:

1. A cast superalloy article having a unidirectional crystal structure that is substantially free of freckle defects having a size greater than 100 um with said article having primary dendrite arm spacing greater than or equal to 150 μm.

2. The cast superalloy article of claim 1 where the unidirectional crystal structure comprises a longitudinal columnar structure aligned parallel with the direction of solidification.

3. The cast superalloy article of claim 1 where the unidirectional crystal structure is a columnar single crystal or columnar polycrystals or mixtures thereof.

4. The cast superalloy article of claim 3 where the unidirectional crystal structure is the columnar single crystal.

5. The cast superalloy article of claim 3 where the single crystal is the <001> direction.

6. The cast superalloy article of claim 1 where the superalloy is a nickel-base or coblalt-base alloy.

7. The cast superalloy article of claim 6 where the nickel-base alloy comprises the composition of about 7.5 weight percent Co, 7.0 weight percent Cr, 6.2 weight percent Al, 6.5 weight percent Ta, 1.5 weight percent Mo, 5.0 weight percent W, 3.0 weight percent Re, the balance Ni with minor dopings of Hf, Y, B, and C.

8. The cast superalloy article of claim 1 where the article length is between about 4 and 40 inches.

9. The cast superalloy article of claim 1 where the primary dendrite arm spacing is between 150 and 800 μm.

10. The cast superalloy article of claim 1 where there are few or no casting defects present that affect the performance and overall properties of the cast superalloy article.

11. The cast superalloy article of claim 1 that is a component for a gas turbine.

12. The cast superalloy article of claim 11 where the component is a blade.

13. The cast superalloy article of claim 12 where the blade has at least one surface coating.

14. A directionally solidified single crystal superalloy article comprising a composition of about 7.5 weight percent Co, 7.0 weight percent Cr, 6.2 weight percent Al, 6.5 weight percent Ta, 1.5 weight percent Mo, 5.0 weight percent W, 3.0 weight percent Re, the balance Ni with minor dopings of Hf, Y, B, and C having primary dendrite arm spacing between about 150 μm to about 800 μm and a length from about four (4) inches to about forty (40) inches.

15. The directionally solidified single crystal superalloy article of claim 14 having a crystal direction of <001>.

16. The directionally solidified single crystal superalloy article of claim 14 being substantially defect free where there are few or no casting defects present that affect the performance and overall properties of the cast superalloy article.

17. The directionally solidified single crystal superalloy article of claim 14 where the article is a component for a gas turbine.

18. The directionally solidified single crystal superalloy article of claim 17 where the component is a blade having a dovetail connected to a disk, and having a shank, a platform and a vane.

19. The directionally solidified single crystal superalloy article of claim 18 where the surface of the vane has at least one coating.

20. A high-gradient, directionally solidified cast article comprising superalloy metal having a single crystal longitudinal columnar structure parallel to the direction of solidification with primary dendrite spacing of at least 150 μm and a length up to about 40 inches wherein said superalloy comprises a composition of about 7.5 weight percent Co, 7.0 weight percent Cr, 6.2 weight percent Al, 6.5 weight percent Ta, 1.5 weight percent Mo, 5.0 weight percent W, 3.0 weight percent Re, the balance Ni with minor dopings of Hf, Y, B, and C.

21. The high gradient, directionally solidified cast article of claim 20 where the single crystal is the <001> direction.

22. The high gradient, directionally solidified cast article of claim 20, where the primary dendrite arm spacing is between about 10 to 20 μm per inch of article length.

23. The high gradient, directionally solidified cast article of claim 20 being substantially defect free where there are few or no casting defects present that affect the performance and overall properties of the cast superalloy article, where said article is a component for a gas turbine and a temperature of said article is not less than 900° C. under working stress.

24. The high gradient, directionally solidified cast article of claim 22 where the component is a blade having a dovetail connected to a disk, and having a shank, a platform and a vane.

25. The high gradient, directionally solidified cast article of claim 24 where the blade is a member of a first stage in the turbine.

26. The high gradient, directionally solidified cast article of claim 24 where the vane has at least one coating.

27. A directionally solidified component for a gas turbine, such as a blade, nozzle, bucket, or vane, comprising a single crystal superalloy metal between about 4 and 40 inches in length, being substantially free of defects, and having a primary dendrite arm spacing about 5 μm to 30 μm per inch of component length and a component length up to and including 40 inches.

28. A directionally solidified component for a gas turbine, comprising polycrystalline superalloy metal having columnar structure parallel to the direction of solidification with a primary dendrite arm spacing about 5 μm to 30 μm per inch of component length and a component length up to and including 40 inches.

29. A gas turbine comprising a turbine disk, at least one stage of a turbine blade connected to the disk, said blade having an overall length greater than about four inches, being made of a high gradient cast unidirectional solidified superalloy metal having a columnar single crystal or polycrystal structure with a primary dendrite arm spacing about 5 μm to 30 μm per inch of blade length; and a turbine nozzle in correspondence to the turbine blade, said nozzle having an overall length greater than about four inches, being made of a high gradient cast unidirectional solidified superalloy metal having a columnar single crystal or polycrystal structure with a primary dendrite arm spacing about 5 μm to 30 μm per inch of nozzle length.

30. A turbine blade, nozzle, bucket, vane and airfoil comprising a superalloy metal cast as a columnar single crystal with crystallographic direction of <001> having a primary dendrite arm spacing of 5 μm to 30 μm per inch for blade, nozzle, bucket, vane and airfoil lengths of four inches to forty inches.

31. A heavy-duty gas turbine comprising a compressor, a combustion liner, a turbine blade, in a single stage or multi-stages, which has a dovetail secured to a turbine disk where said blade has an overall length between about four and forty inches, is made of a superalloy metal columnar single crystal or columnar polycrystals or mixtures thereof, having primary dendrite arm spacing of 5 μm to 30 μm per inch.

32. The heavy duty gas turbine of claim 31 where a turbine nozzle is provided in correspondence to the turbine blade, wherein a maximum operating gas temperature is not less than 1000° C., and metal temperatures of a first blade is not less than 900° C. under working stress.

33. A gas turbine comprising an arrangement of blades and nozzles, each blade having a vane part, a platform, and a shank part and each nozzle having a vane part and platform, wherein each blade provided at a disk is rotated by allowing a compressed combustion gas to pass through a nozzle and to collide against a blade in which temperature of the combustion gas is 1000° C. or higher, temperature of the combustion gas at an inlet for a vane part of a blade of a first stage is at least 1000° C., the blade of the first stage is a columnar single crystal, has a length of at least four inches, and a primary dendrite arm spacing of 5 μm to 30 μm per inch.

34. A method of making a directionally solidified columnar single crystal or columnar polycrystalline article comprising the steps of: pouring a molten superalloy metal in a heated zone into a preheated mold comprising a main cavity having the shape of the cast article; withdrawing the mold with the molten superalloy metal from the heated zone into a liquid cooling tank at a withdrawal rate sufficient to maintain a thermal gradient greater than 10–12° C./cm to solidify the molten metal to form primary dendrite arm spaces greater than or equal to 150 μm but less than or equal to 800 μm corresponding to a length of the cast article between about 4 to about 40 inches, respectively; and subsequent cooling of the mold to effect the columnar single crystallization or columnar polycrystallization or mixtures thereof that is substantially defect free.

35. The article made according to the method of claim 34.

* * * * *